United States Patent [19]

Allonsius

[11] 4,273,335

[45] Jun. 16, 1981

[54] INDICIA SELECTOR

[76] Inventor: Georges Allonsius, 17 Lascelles Blvd., Suite 208, Toronto, Ontario, Canada, M4V 2B6

[21] Appl. No.: 93,054

[22] Filed: Nov. 13, 1979

[51] Int. Cl.[3] ..... A63F 7/04

[52] U.S. Cl. ..... 273/144 B

[58] Field of Search ..... 221/266; 273/144 R, 273/144 A, 144 B, 139

[56] References Cited

U.S. PATENT DOCUMENTS

| | | | |
|---|---|---|---|
| 1,866,063 | 7/1932 | Sloan | 273/144 B |
| 3,289,321 | 12/1966 | Sussman | 273/144 B |
| 3,856,312 | 12/1974 | Dabrowski | 273/144 A |

*Primary Examiner*—Stanley H. Tollberg

[57] ABSTRACT

According to the present invention, a portable hand held indicia selector is provided for the random selection of indicia which makes the selector particularly suitable for lottery selections. The selector comprises a totally enclosed unit consisting of an opaque mixing chamber with a transparent deposit chamber. Enclosed within the selector are a plurality of indicia bearing members moveable between the two chambers. The arrangement is such that the indicia bearing members are hidden from view when in the mixing chamber and are moved at random to the deposit chamber where they are clearly apparent for recording the random selection.

9 Claims, 5 Drawing Figures

INDICIA SELECTOR

FIELD OF THE INVENTION

The present invention relates to an indicia selector which is particularly suitable for randomly selecting lottery numbers in lotteries where the participants are allowed to pick their own numbers.

BACKGROUND OF THE INVENTION

Over the last few years there has been a substantial move to lotteries in which the participants select their own numbers; letters and whatever other indicia is used to play the lottery and a record is kept of their selection. If their selection matches the selection drawn in the lottery, whether in whole or in part, the participants are lottery winners. Examples include Lotario, Loto Quebec, New York State Lottery Keno, as well as many others.

In the type of lottery described above, the participants have to make a large number of selections. For instance, in Lotario, the participants make a selection of 6 numbers out of a possible 39 for a single ticket costing a dollar. If they play more than one ticket then they have to select 6 more numbers for each additional ticket costing an additional dollar per ticket. The requirement of making such a high number of selections presents a difficulty to the majority of the participants. Many people use the dates of special occasions such as birthdays of relatives and friends for a basis of selecting some of their numbers. Other paticipants develop complicated mathematical systems based on numbers that may have some significance to them. However, even people employing these methods find it difficult to make the required number of selections in a short period of time. The participants without any particular method of selecting numbers find it even more difficult and time consuming and can even find it to be a restraint against playing in any future lotteries.

Devices have been developed in the past for providing a predetermined selection for card games and the like. However, none of these prior art devices are satisfactory for making lottery selections for a number of reasons including among other things, their non-portability which makes them unusuable for on the spot lottery selections, their inability to provide for a thorough mixing of all of their contents, their open construction which easily permits the loss of their contents and the nonrandom selection of their contents.

The present invention provides a selector which answers the problem of selecting numbers or letters or any other indicia for lotteries and the like, without suffering from the drawbacks of conventional structures. The indicia selector of the present invention which provides for a totally random selection is portable to the extent that it is hand held and operated. It is a total-enclosed unit containing a plurality of indicia bearing members which are maintained within the unit. The unit itself consists of an opaque mixing chamber for mixing the indicia bearing members, a transparent deposit chamber separated from the mixing chamber and means for moving the indicia bearing members from the mixing chamber to the deposit chamber and back to the mixing chamber. The overall arrangement is one in which the indicia bearing members in the mixing chamber are hidden from view and mixable with one another for random movement to the deposit chamber where they are maintained, clearly apparent in the order in which they are moved to the deposit chamber until they are returned to the mixing chamber.

The selector of the present invention has, as mentioned above, particular application as a lottery number selector. The participant simply shakes the unit when all of the indicia bearing members, which may be in the form of numbered or lettered balls, are in the mixing chamber for a thorough mixing of the members and thereafter, moves the required number of members to the deposit chamber. The indicia on the members is then recorded on an appropriate chart in the order in which they appear in the deposit chamber for a very fast and simple lottery selection. After the selection has been made, all of the members are moved back to the mixing chamber for future selections.

BRIEF DISCUSSION OF THE DRAWINGS

The above, as well as other advantages and features of the present invention will be described in greater detail according to the preferred embodiments of the present invention wherein.

DETAILED DESCRIPTION ACCORDING TO THE PREFERRED EMBODIMENTS OF THE PRESENT INVENTION

Figure 1:
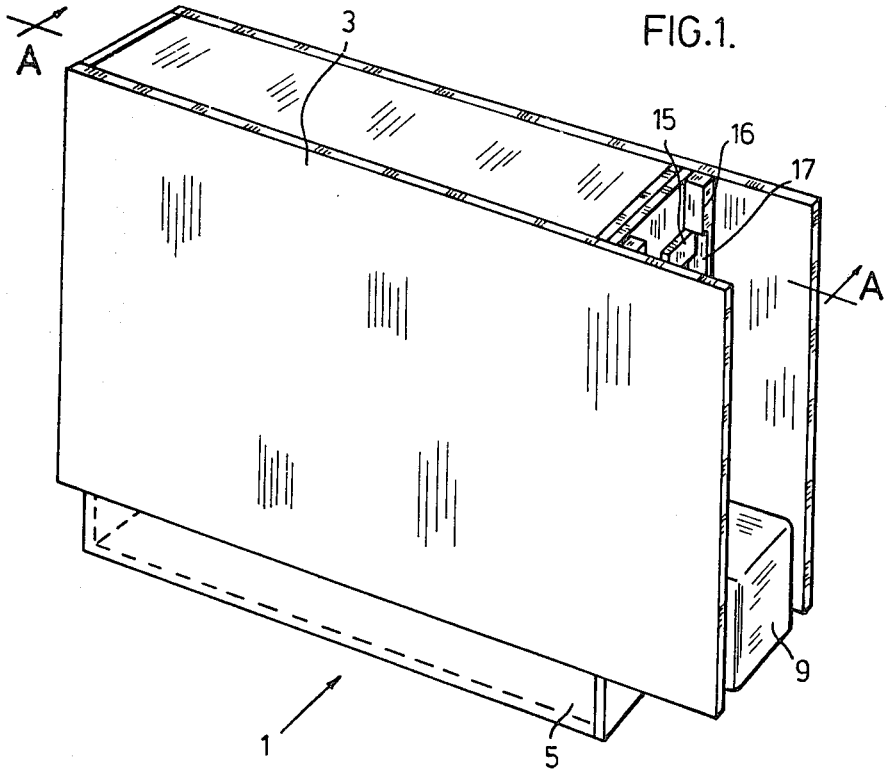
FIG. 1 is a perspective view looking down on a preferred form of a selector according to the present invention.
Figure 2:
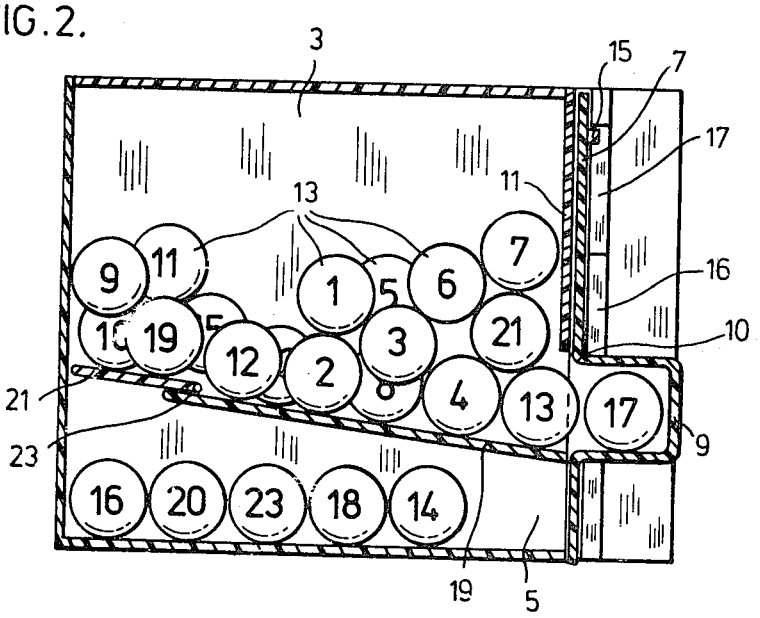
FIGS. 2 through 4 are sectional views taken along the lines A—A of FIG. 1 with FIG. 4 showing the selector turned upside down.
Figure 3:
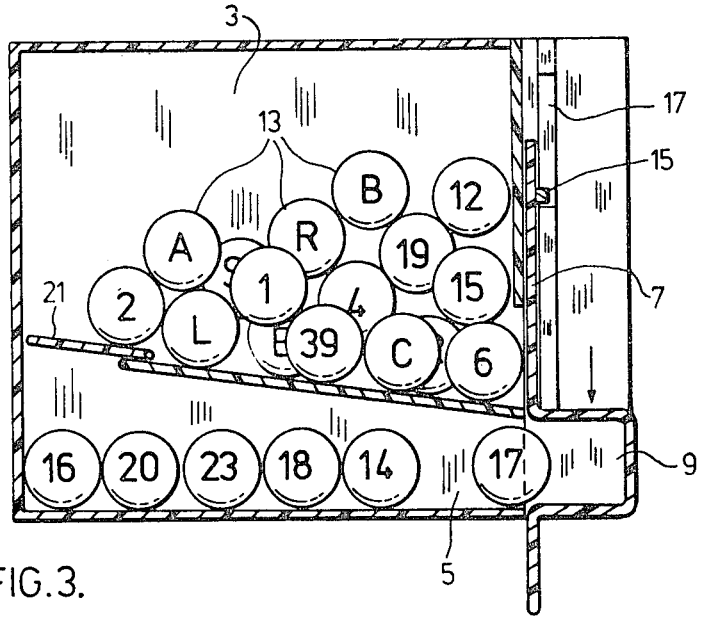
Figure 4:
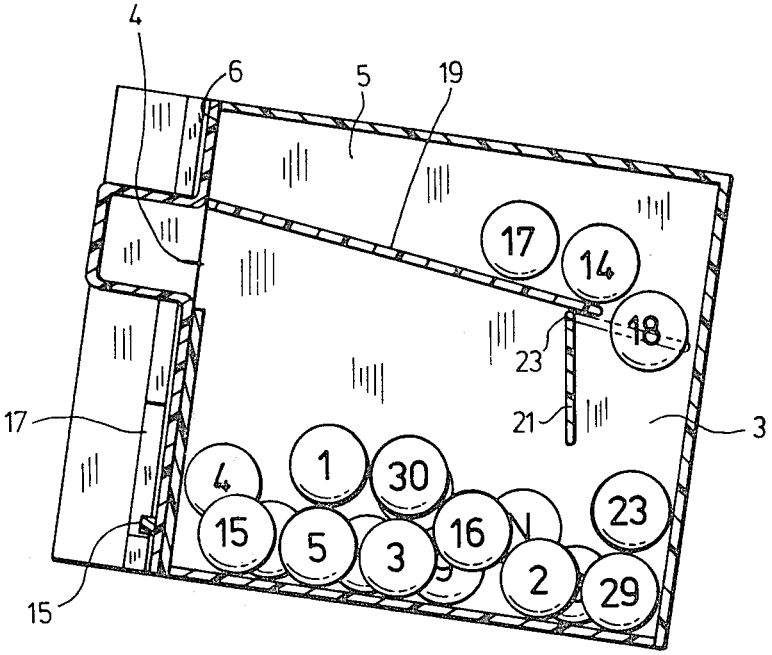
Figure 5:
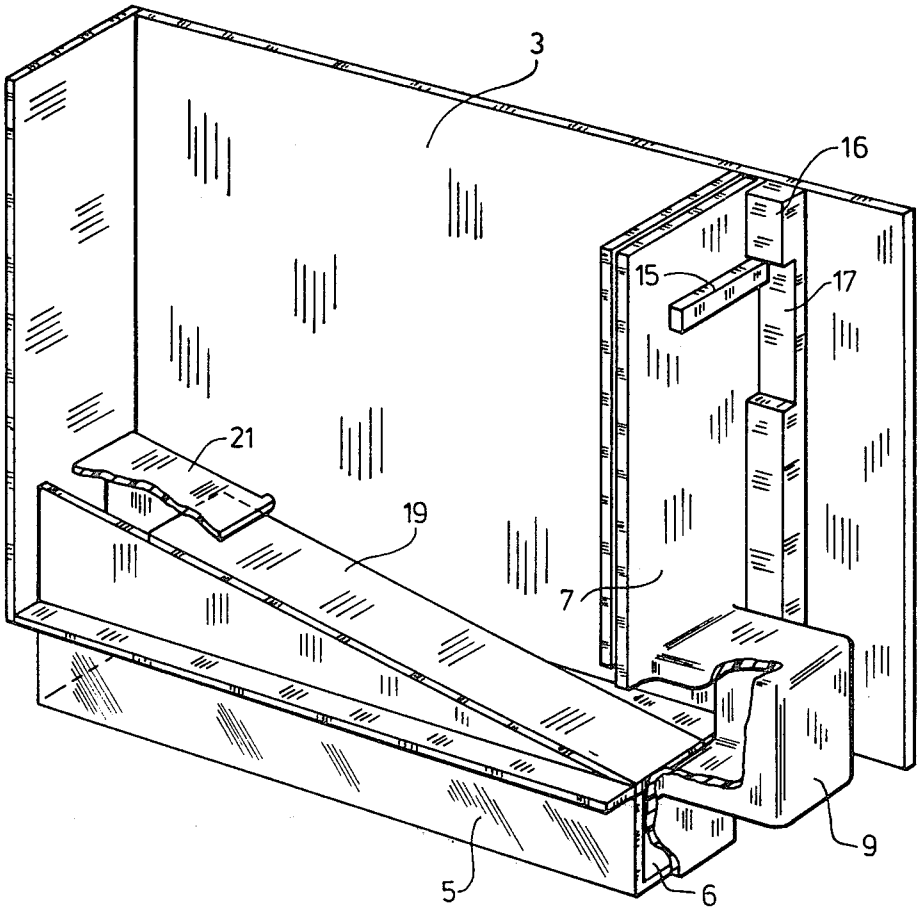
FIG. 5 is a partial sectional view of the selector shown in FIG. 1.

The selector which is generally indicated at 1, in FIG. 1, comprises a totally enclosed and sealed unit formed of an upper opaque mixing chamber 3 and a lower transparent deposit chamber 5. A plurality of numbered balls 13, each of which bears a number unique to that ball, are stored within the unit. (FIG. 3 shows some lettered balls mixed in with the numbered balls.) These balls are moveable from the mixing chamber to the deposit chamber via a slide member 7, having an individual ball receptacle 9. The balls are returned to the mixing chamber from the deposit chamber through a oneway trap door 21 which hinges at 23 when the unit is reversed or tipped upside down as shown in FIG. 4.

Provided interiorly of the unit is a ramp 19 which separates the two chambers and which, when the unit is upright, slopes toward ball receptacle 9 of slide member 7. The slide member itself slides relative to interior wall 11 and exterior bracket portions 16 provided with grooves 17 for receiving stop 15 of the slide member.

Unit 1 is portable and may be carried in a pocket or purse by a lottery participant. The unit is hand held and operated and provides an extremely effective device for making a fast and easy lottery selection. The lottery participant first assures that all of the numbered balls are contained in the upper mixing chamber which is dimensioned to permit a thorough mixing of the balls. The participant simply shakes the unit to provide for the intermixing of the balls with one another and once the balls have come to rest, ramp 19 guides them downwardly through opening 4 to ball receptacle 9. The slide member which may be spring loaded for a return movement is then forced downwardly with one ball housed in the receptacle to move that ball from the mixing chamber through opening 6 to the deposit chamber.

Slide member 7 may be provided with a rounded corner as indicated at 10 to assist in the shearing action at the interface of the balls to allow for easy sliding of member 7. The alignment of the ball receptacle with respect to the chamber openings 4 and 6 is determined by the travel of stop member 15 in grooves 17, i.e., when the stop member is at the upper end of the grooves, receptacle 9 is aligned directly with opening 4 exiting from the mixing chamber and when the stop member is stopped at the base of the grooves, the ball receptacle is aligned with opening 6 entering to the deposit chamber.

As will be understood from the drawings, the numbered balls are moved one at a time, from mixing chamber to the deposit chamber which simulates actual conditions in the lottery selection. The deposit chamber is dimensioned such that once the numbered balls are moved to the deposit chamber, they are maintained in the order in which they are deposited. In other words, they are not permitted to roll by one another.

As will be appreciated from the description given above, when the balls are in the upper chamber 3, they are completely hidden from view, so that the individual using the unit has no idea as to which balls will be carried downwardly by the slide member to the deposit chamber. However, once the numbered balls are in the deposit chamber, they are clearly apparent and as earlier mentioned, maintained in their deposited order. This order is recorded on a standard lottery sheet for making the lottery selection.

After the first selection has been made, the deposited balls are returned from the transparent chamber 5 to opaque chamber 3 through trap door 21 by simply turning the unit upside down as shown in FIG. 4. The trap door pivots under its own weight and if required under the weight of the balls, about pivot point 23. It should be noted that ramp 19 is reversed in direction when the unit is turned upside down such that it leads the balls to the trap door which acts as a oneway valve such that when the unit is returned to the upright position, the trap door does not permit the return movement of the balls back to the deposit chamber.

After all of the balls have been returned to the mixing chamber, from the deposit chamber, the unit may again be shaken to provide for a thorough mixing of all of the balls for further lottery selections.

The unit shown and described in the drawings, exemplifies a very basic arrangement according to the present invention. It is to be understood that other types of means for moving the indicia bearing members to and from both the mixing chamber as well as the deposit chamber, such as plungers and the like could be used in replacement for what is shown in the drawings. In addition, other shapes of members bearing different indicia can be used rather than the numbered and lettered balls described above. The unit can also be set up such that it automatically moves a plurality of the indicia bearing members from the mixing chamber to the deposit chamber in one shot rather than on an individual basis.

The unit described above is inexpensive and easy to construct. Furthermore, because of its low cost and selling price, it can be sold directly at the lottery ticket outlets along with the lottery tickets. However, once the unit has been purchased it can be used for future lotteries.

The prime use of the present invention is intended for lottery selections which incorporate a procedure or scheme for the distribution of prizes through drawing of lots by fate or chance. However, even though certain preferred embodiments of the invention, have been described above, it will be appreciated by one skilled in the art that variations of those embodiments as well as intended uses, will be apparent to one skilled in the art and that they will fall within the spirit of the invention and the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A portable handheld indicia selector for selecting indicia at random and being particularly suitable for lottery selections, said selector comprising a totally enclosed unit consisting of an opaque mixing chamber for mixing a plurality of indicia bearing members, each of which bears its own distinct indicia, a transparent deposit chamber to which said indicia bearing members are deposited directly from said mixing chamber, wall means separating said deposit chamber from said mixing chamber and means for moving the indicia bearing members past said wall means from one chamber to the other, such that the members deposited in the deposit chamber are maintained therein in the order in which they are moved, the arrangement being such that the indicia bearing members in the mixing chamber are hidden from view and mixable with one another for random movement to the deposit chamber where they are clearly apparent.

2. A portable handheld lottery number selector for randomly selecting lottery numbers, said selector comprising a totally enclosed and sealed unit consisting of an upper opaque mixing chamber for mixing a plurality of numbered balls each of which bears its own distinct number, a lower transparent deposit chamber to which said balls are deposited directly from said mixing chamber, a wall separating said deposit chamber from said mixing chamber, a sliding member which is slidable between the two chambers and which is provided with a ball receptacle adapted to receive at least one of said numbered balls for moving the numbered balls around one end of said wall from the mixing chamber to the deposit chamber such that the numbered balls deposited in the deposit chamber are maintained therein in the order in which they are moved and means for returning the numbered balls from the deposit chamber back to the mixing chamber, the arrangement being such that the balls in the mixing chamber are hidden from view and intermixable with one another for random movement to the deposit chamber to which they are moved individually and in which they are held clearly visible until they are returned to the mixing chamber.

3. A portable handheld lottery number selector as claimed in claim 2 wherein, said ball receptacle is adapted to receive one of said numbered balls such that said numbered balls are moved individually, by said sliding member from the mixing chamber to the deposit chamber.

4. A lottery number selector as claimed in claim 2 including ramp means for directing the numbered balls to the ball receptacle of the sliding member.

5. A lottery number selector as claimed in claim 4, wherein said ramp means separates the mixing chamber from the deposit chamber.

6. A lottery number selector as claimed in claim 5 wherein said means for returning the numbered balls from the deposit chamber back to the mixing chamber, comprises a pivotal one way trap door which opens inwardly to the mixing chamber.

7. A portable hand held lottery number selector as claimed in claim 2, wherein said mixing chamber is provided with an exit opening and said deposit chamber is provided with an entrance opening, both of said openings being located adjacent said sliding member, said individual ball receptacle moving between said openings, said sliding member being provided with a stop portion moveable within a recessed portion on said lottery number selector to assure proper alignment of said ball receptacle with said openings.

8. A portable handheld indicia bearing member selector for selecting indicia bearing members at random, said selector comprising a totally enclosed and sealed unit consisting of an upper opaque mixing chamber for mixing a plurality of said indicia bearing members, a lower transparent deposit chamber separted from said mixing chamber, an indicia bearing member receptacle slidable between the two chambers for moving at least one of said members from the mixing chamber to the deposit chamber and means for returning the members from the deposit chamber back to the mixing chamber, the arrangement being such that the indicia bearing members in the mixing chamber are hidden from view and intermixable with one another for random movement to the deposit chamber and in which they are clearly apparent and maintained in the order in which they are moved until they are returned to the mixing chamber.

9. A portable handheld indicia bearing member selector as claimed in claim 8 wherein said indicia bearing members are selected from the group consisting of numbered balls and lettered balls.

* * * * *